US008523034B2

(12) United States Patent
Fuchs et al.

(10) Patent No.: US 8,523,034 B2
(45) Date of Patent: Sep. 3, 2013

(54) DEVICE FOR FEEDING A PRINTING-MATERIAL WEB TO AN ELECTROGRAPHIC PRINTING DEVICE

(75) Inventors: Werner Fuchs, München (DE); Christian Kürmeier, Erding (DE)

(73) Assignee: Océ Printing Systems GmbH, Poing (DE)

( * ) Notice: Subject to any disclaimer, the term of this patent is extended or adjusted under 35 U.S.C. 154(b) by 651 days.

(21) Appl. No.: 12/670,246

(22) PCT Filed: Jul. 23, 2008

(86) PCT No.: PCT/EP2008/059623

§ 371 (c)(1), (2), (4) Date: Jan. 25, 2010

(87) PCT Pub. No.: WO2009/013300

PCT Pub. Date: Jan. 29, 2009

(65) Prior Publication Data

US 2010/0202818 A1 Aug. 12, 2010

(30) Foreign Application Priority Data

Jul. 23, 2007 (DE) ..... 10 2007 034 246

(51) Int. Cl.
*B65H 20/32* (2006.01)
*B65H 23/035* (2006.01)
*B65H 20/40* (2006.01)

(52) U.S. Cl.
USPC ..... 226/16; 226/42; 226/118.4; 242/417.1

(58) Field of Classification Search
USPC ..... 226/3, 4, 15, 16, 19–24, 34, 35, 42, 226/43, 117, 118.4, 118.5, 154, 155, 195; 242/417.1, 418.1, 552
See application file for complete search history.

(56) References Cited

U.S. PATENT DOCUMENTS

| | | | | |
|---|---|---|---|---|
| 3,436,002 | A | 4/1969 | Racine | |
| 3,464,610 | A | 9/1969 | Koning | |
| 3,645,619 | A * | 2/1972 | Burton et al. | 355/40 |
| 3,807,612 | A * | 4/1974 | Eggert | 226/42 |
| 3,829,080 | A | 8/1974 | Braen et al. | |
| 3,904,145 | A * | 9/1975 | Steinberger et al. | 242/412.2 |

(Continued)

FOREIGN PATENT DOCUMENTS

| | | |
|---|---|---|
| DE | 351969 | 6/1967 |
| DE | 2 205 366 | 8/1972 |

(Continued)

*Primary Examiner* — Sang Kim
*Assistant Examiner* — Scott Haugland
(74) *Attorney, Agent, or Firm* — Schiff Hardin LLP

(57) ABSTRACT

In a device for supplying a printing substrate web to an internal transport path of the printing substrate web of a printing device, a device accepts the printing substrate web from the printing substrate web source. A drive unit is provided at an output of the device and draws the printing substrate web from the device. A buffer device having a buffer reservoir is provided at an output of the drive unit. The buffer reservoir has a negative pressure device that generates a negative pressure in a buffer reservoir. The negative pressure acts on the printing substrate web to pull the printing substrate web drawn by the drive unit into the buffer reservoir and thereby tensions the printing substrate web before it is supplied to the internal transport path.

17 Claims, 5 Drawing Sheets

(56) References Cited

U.S. PATENT DOCUMENTS

| | | | | |
|---|---|---|---|---|
| 4,070,951 | A | 1/1978 | Bala | |
| 4,199,766 | A | 4/1980 | Blossey et al. | |
| 4,253,597 | A * | 3/1981 | Waffner | 226/40 |
| 5,031,847 | A * | 7/1991 | Tanaka | 242/417.3 |
| 5,137,225 | A | 8/1992 | Biagiotti | |
| 5,501,412 | A * | 3/1996 | McAleavey | 242/417.1 |
| 5,540,146 | A | 7/1996 | Lapp | |
| 5,558,263 | A * | 9/1996 | Long | 226/114 |
| 5,685,471 | A | 11/1997 | Taubenberger | |
| 5,729,817 | A | 3/1998 | Raymond et al. | |
| 6,068,172 | A | 5/2000 | Huber | |
| 6,164,583 | A | 12/2000 | Spatafora | |
| 6,246,856 | B1 | 6/2001 | Kopp et al. | |
| 6,334,564 | B1 * | 1/2002 | Kishine et al. | 226/42 |
| 6,352,257 | B1 * | 3/2002 | Todaro et al. | 271/268 |
| 6,592,276 | B2 * | 7/2003 | Ohba et al. | 400/582 |
| 6,601,951 | B2 * | 8/2003 | Kuwabara et al. | 347/101 |
| 6,969,206 | B2 * | 11/2005 | Iwanaga et al. | 400/618 |
| 7,454,162 | B2 | 11/2008 | Segerer et al. | |
| 2003/0039496 | A1 | 2/2003 | Miyamoto et al. | |
| 2003/0116042 | A1 * | 6/2003 | Ohba et al. | 101/225 |
| 2003/0188647 | A1 | 10/2003 | Ullrich et al. | |
| 2005/0158099 | A1 | 7/2005 | Segerer et al. | |

FOREIGN PATENT DOCUMENTS

| | | | |
|---|---|---|---|
| DE | 25 27 655 | | 1/1976 |
| DE | 27 21 003 | | 11/1977 |
| DE | G 83 17 604.7 | | 8/1984 |
| DE | 690 17 291 | | 1/1991 |
| DE | 197 26 874 | A1 | 1/1999 |
| DE | 699 05 413 | | 10/1999 |
| DE | 101 57 118 | | 5/2003 |
| DE | 10 2004 002 232 | | 8/2005 |
| DE | 10 2004 010 480 | | 9/2005 |
| DE | 10 2006 056 896 | | 6/2007 |
| DE | 10 2006 002 471 | | 7/2007 |
| EP | 0 740 638 | | 11/1996 |
| EP | 0 756 215 | | 1/1997 |
| FR | 2 385 627 | | 10/1978 |
| GB | 1 332 082 | | 10/1973 |
| GB | 1 332 083 | | 10/1973 |
| GB | 1 469 844 | | 4/1977 |
| GB | 2 023 553 | | 1/1980 |
| GB | 1 570 055 | | 6/1980 |
| GB | 1 584 211 | | 2/1981 |
| JP | 09 086742 | | 3/1997 |
| WO | WO 98/39691 | | 9/1998 |
| WO | WO 2005/092580 | | 10/2005 |
| WO | WO 2007/082755 | | 7/2007 |

* cited by examiner

DEVICE FOR FEEDING A PRINTING-MATERIAL WEB TO AN ELECTROGRAPHIC PRINTING DEVICE

BACKGROUND

Different problems can be present in the transport of a printing substrate web to an electrographic printing device. For example, problems occur when the printing substrate web is delivered from differently arranged sources, for example from differently arranged printing substrate web stacks or from another printing device or from different types of printing substrate webs (a printing substrate web of a different width, pre-folded). In order to prevent web tears or web loops of the printing substrate web that are too large, storage buffers for the printing substrate web are provided. In a printing device a storage buffer is also required in order to have a sufficient reserve of printing substrate web upon starting and stopping the printing device. In particular, due to the re-proofing calculated for the pages in the retraction required in the printing device (for example in color printing), based on the start ramp-up to reach the printing speed a reserve amount of printing substrate web must be held back in order to avoid a tearing of the printing substrate web.

It is known (for example WO 98/39691 A1 or U.S. Pat. No. 6,246,856 B1) to solve this problem with the aid of what is known as a dancing roller arranged in a reserve buffer, a roller resting freely directed on the printing substrate web. If a loosening of the printing substrate web (a sagging of the printing substrate web) occurs in operation, this is drawn by the weight of the dancing roller into the reserve buffer and a loop is therefore formed. For example, this can be executed (for example DE 10 2004 002 232.1-51) such that sensors scanning the loop are arranged in the reserve buffer, which sensors output sensor signals indicating the length of the loop that are used to control the transport of the printing substrate web.

U.S. Pat. No. 6,068,172 A describes an electrographic printing device with a printing substrate transport device. A drive unit (made up of two drive rollers 12, 13) that transport the printing substrate into the printing device are provided outside the printing device. The printing substrate web is supplied in the printing device via a tension spring to a pendulum and from there arrives via deflection rollers at the transfer printing station in which the toner images are transfer-printed onto the printing substrate. After the transfer printing station an additional drive unit is provided that draws the printing substrate from the transfer printing station. The printing substrate conveyed by the drive unit into the printing device is supplied, tensioned by the tension spring, to the pendulum. The drive unit is thereby controlled by the tension of the printing substrate since the wrap angle of the printing substrate around the rollers is changed depending on the tension of the printing substrate. Depending on this angle, the drive motor for the rollers is regulated such that the deflection of the pendulum is between the end positions of the pendulum.

A device with which paper sheets can be laterally aligned arises from U.S. Pat. No. 3,436,002 A.

US 2005/158099 A1 discloses a device that is arranged at the output of a printing device in order to prepare the printing substrate for the processing by a post-processing apparatus. The printing substrate is initially supplied to a buffer storage, and arrives from there at a smoothing device. The printing substrate is subsequently moistened in a moistening device and is finally cooled in a cooling device. The printing substrate is subsequently supplied to the post-processing apparatus.

JP 09 086742 A describes a paper transport device in which the paper web is extracted from a storage roll, is directed via a brake to a buffer consisting of a spring, and subsequently arrives at a feed unit. The goal is to keep the paper web tensioned at the start of the feed of said paper web. This is achieved in that a slack of the paper web is accepted by the buffer and is additionally braked before the buffer. The paper web is therefore supplied to the feed unit in a tensioned state.

EP 0 756 215 A shows a device with which a printing substrate web can be cleaned on both sides. For this the printing substrate web is directed in an S-shape past cleaning rollers.

U.S. Pat. No. 5,540,146 A describes a device with which a printing substrate web can be laterally aligned. The alignment occurs with the aid of a sensor that scans the edge of the printing substrate web. The printing substrate web is mechanically aligned depending on the scan signal.

DE 27 21 003 A discloses a transport device for a printing substrate web via which a deviation and a zigzag movement of the paper web during the feed can be corrected.

GB 2 023 553 A shows a buffer storage with a negative pressure chamber at whose floor is arranged a vacuum pump that generates in the chamber a negative pressure via which the paper web is drawn into the chamber. A drive unit for the paper web is provided at the input of the chamber (as viewed in the transport direction of the paper web). The drive unit is arranged at a distance from the chamber.

A buffer device for a belt with two buffer stores situated in series, between which is arranged a drive drum that can be driven in both directions, arises from GB 1 469 844 A. The buffer stores are realized as negative pressure chambers in which respective sensors for scanning the loop length are arranged.

U.S. Pat. No. 3,464,610 A describes a paper transport device with a vacuum chamber in which sensors to scan the loop length are provided. A vacuum source is arranged on the floor of the chamber. A channel in which a negative pressure is generated is provided in the outer wall over which the paper web is drawn (by a drive unit), via which negative pressure an air cushion is formed at the end of the channel and at the input of the vacuum chamber over which the paper web is directed to the drive unit.

A buffer for a belt arises from U.S. Pat. No. 4,199,766 A. The belt is drawn into the buffer by the force of gravity. A gas cushion exists at the floor of the buffer.

U.S. Pat. No. 3,829,080 A shows a buffer storage that operates with negative pressure. The vacuum source is arranged at the floor of the buffer memory. A channel via which an air cushion is formed under the paper web before this is supplied to the drive unit is provided in the side wall.

FR 2 385 627 A describes a chamber through which a belt is directed downward through an opening at the floor of the chamber. The chamber is executed at an angle at the floor.

US 2003/039496 A1 deals with a printing in which a buffer storage is arranged before the transfer printing station. Three sensors with which the loop length is scanned are arranged in the buffer storage. The unit is arranged at the input of the buffer storage.

U.S. Pat. No. 5,729,817 A describes a color printing device with buffer stores that are realized as loop pullers.

US 2003/188647 A1 shows a printing device that has at an input an input module with a tensioning device for the paper web.

A regulation for transport of a printing substrate web in an electrographic printing apparatus is known from DE 10 2004 002 232 A1 or the corresponding US 2005/158099 A1.

FIG. 1 shows the design of an electrographic printing device DR as it is described in, for example, WO 98/39691 A1 or U.S. Pat. No. 6,246,856 B1; WO 98/39691 A1 and U.S. Pat. No. 6,246,856 B1 are herewith incorporated into the disclosure. The printing device DR has a printing module M2 and a fixing module M3. Arranged at the input of the printing module M2 for a printing substrate web 10 is a feed module M1 for the printing substrate web 10.

The printing module M2 contains (as an example) two electrophotography units E1 and E2 of known design that respectively generate toner images of images to be printed on a photoconductor belt; these toner images are transfer-printed onto transfer belts T1, T2, there are collected upon color printing, and finally the toner images are transfer-printed from the transfer belts T1, T2 onto the printing substrate web 10. The functions of the printing module M2 can be individually learned from WO 98/39691 A1.

The toner images are fixed on the printing substrate web 10 (for example with the aid of radiation fixing) in module M3; refer also in this regard to WO 98/39691 A1.

The feed module M1 for the printing substrate web 10 is arranged in the printing device DR in WO 98/39691 A1 or U.S. Pat. No. 6,246,856 B1. It contains a reserve buffer VP with a loop puller 11 that collects a slack of the printing substrate web 10. This is particularly of importance in start-stop operation of the printing module M2 since it can therefore be prevented that the printing substrate web 10 tears. From the feed module M1, the printing substrate web 10 arrives at the internal transport path TW for the printing substrate web 10 within the printing module M2. The feed module M1 can receive new printing substrate web, for example from a printing substrate web stack (not shown in FIG. 1) or from a printing device arranged beforehand in a printing path as a source of the printing substrate web.

The feed module M1 according to FIG. 1 is part of the printing device DR and is adapted to the needs of the printing device DR. Therefore problems occur if the printing device is, for example, part of a printing path made up of multiple printing devices and the printing path is changed or different printing substrate webs are used.

SUMMARY

An object is to specify a device for the feed of a printing substrate web to a printing device with which the requirements that the printing substrate web can be optimally aligned and fed to the printing device in a tensioned state are met. If, upon stopping the printing process (for example given color printing), printing substrate web is conveyed backward into a slack condition, upon restarting the printing process a shock to the printing substrate web that occurs at the moment at which the printing substrate web tightens again should be prevented.

In a device for supplying a printing substrate web to an internal transport path of the printing substrate web of a printing device, a device accepts the printing substrate web from the printing substrate web source. A drive unit is provided at an output of the device and draws the printing substrate web from the device. A buffer device having a buffer reservoir is provided at an output of the drive unit. The buffer reservoir has a negative pressure device that generates a negative pressure in a buffer reservoir. The negative pressure acts on the printing substrate web to pull the printing substrate web drawn by the drive unit into the buffer reservoir and thereby tensions the printing substrate web before it is supplied to the internal transport path.

DESCRIPTION OF THE PREFERRED EMBODIMENTS

Figure 1:
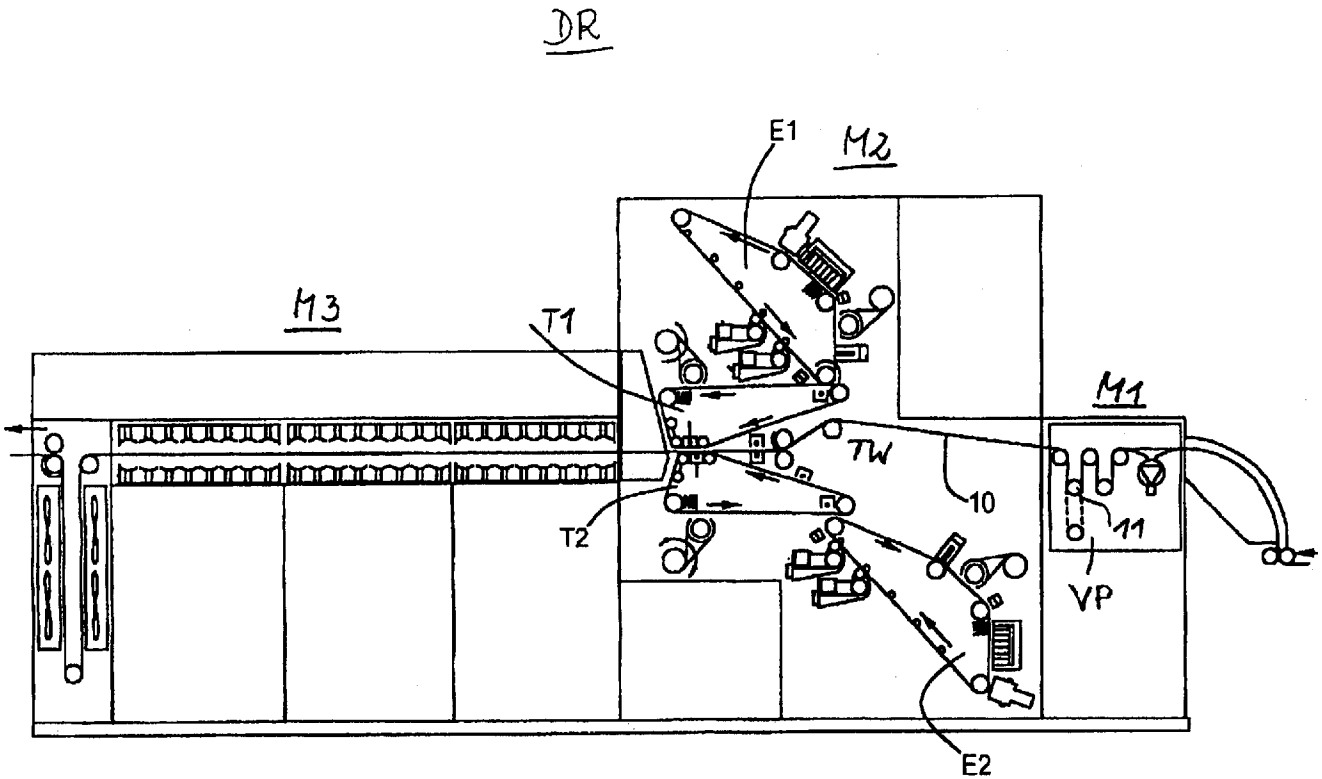
FIG. 1 is an example of a known printing device with a storage buffer in the feed module.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated device and method, and such further applications of the principles of the invention as illustrated as would normally occur to one skilled in the art to which the invention relates are included.

According to a first aspect of the preferred embodiment, the printing substrate web is supplied to the internal transport path of the printing device via a device,

- in which a pre-centering device is provided that accepts the printing substrate web from a printing substrate web source and is designed such that the printing substrate web is laterally aligned after passage and is placed in a tensioned state with minimal force,
- in which a drive unit that draws the printing substrate web from the pre-centering device (and thereby conveys it) is arranged at the output of the pre-centering device,
- in which a buffer device that tensions the printing substrate web before this is supplied to the internal transport path is arranged between drive unit and internal transport path,
- in which the pre-centering device has a guide and tensioning device via which the printing substrate web is directed in an S-shape with a wrapping and that likewise tensions the printing substrate web, and
- in which the pre-centering device is arranged such that it can be adjusted in order to adjust the wrap angle.

In a preferred exemplary embodiment the guide and tensioning device of the pre-centering device has two round extruded profiles over which the printing substrate web is directed in an S-shape. The pre-centering device can be arranged such that it can rotate to adjust the wrap angle. The pre-centering device can have a braking brush before the guide element or before the extruded profiles, which braking brush produces or establishes a tension of the printing substrate web in the pre-centering device. A suction device can be arranged adjacent to the braking brush.

In a further preferred exemplary embodiment of the first aspect of the preferred embodiment, the buffer device has a buffer reservoir in which a negative pressure is generated by a negative pressure device, which negative pressure acts on the printing substrate web directed over the buffer reservoir. At least one sensor can be arranged in the buffer reservoir with which a loop of the printing substrate web in the buffer reservoir is scanned and whose sensor signal is used to regulate the transport of a printing substrate web in the buffer reservoir.

The pre-centering device can have at least one edge guide mounted to the side of the printing substrate web, which edge guide is adjustable to the width of the printing substrate web.

The drive unit can in particular have a drive roller driven by a step motor and a counter-pressure roller.

In a further preferred exemplary embodiment, a drive is respectively provided in the buffer device and in the transport path of the printing device, wherein the two drives are coupled with one another in terms of their control. Furthermore, one or more deflection and/or guide rollers can be provided within the transport path between the buffer device and the printing device, at which deflection and/or guide rollers sensors are provided that scan the parameters of the printing substrate, for example its transport speed or its acceleration. An additional buffer for the printing substrate web can also be additionally provided by means of rollers designed such that they can move, over which rollers the printing substrate web is directed in a wandering manner, and this buffer as well can also be scanned by means of sensors with regard to the quantity of printing substrate web located in the buffer.

The two drives cited above can advantageously be specifically controlled with the signals of the sensors so that the web tension of the printing substrate web is always within a predetermined range in specific movement states (for example start, stop, run-up or shut-down) in the printing device in order to prevent a tearing of the printing substrate web.

The drive unit can also advantageously be arranged on a side wall of the buffer reservoir of the buffer device.

According to an aspect of the preferred embodiment, a buffer device is provided to take up a printing substrate web in an electrographic printing device in that the buffer device has a buffer reservoir under negative pressure and—viewed in the transport direction of the printing substrate web—a drive unit is arranged at the input of the buffer reservoir to transport the printing substrate web into the buffer reservoir.

According to a preferred exemplary embodiment, a negative pressure device that generates a negative pressure acting on the printing substrate web in the buffer reservoir is provided on the floor of the buffer reservoir. The drive unit can be arranged adjacent to and on the edge of the one side wall of the buffer reservoir via which the printing substrate web is supplied to the buffer reservoir. The upper edge of the other side wall of the buffer reservoir via which the printing substrate web is drawn out of the buffer reservoir by the printing device can in particular be designed to be sloped.

Furthermore, the drive unit can comprise a drive roller. In particular, it can have a drive roller and a contact pressure roller that rests on the drive roller such that it can rotate freely, and/or a step motor.

According to a further preferred exemplary embodiment of the invention, the drive unit comprises a first drive roller arranged at the edge of the one side wall and a second drive roller arranged adjacent to the first drive roller in the buffer reservoir, between which first drive roller and second drive roller the printing substrate web is directed, and which first drive roller and second drive roller rotate in the direction of the inside of the buffer reservoir. The second contact pressure roller can be rigidly arranged, can be adjustable in stages inside the buffer reservoir or even be variably or continuously adjustable inside the buffer reservoir.

According to further preferred exemplary embodiments, the buffer device is arranged adjacent to or removed from an input roller of the printing device. Furthermore, a third drive roller that rotates in the direction of the buffer reservoir can thereby be arranged adjacent to the edge of the other side wall. The third drive roller can interact with the contact pressure roller.

According to a further preferred exemplary embodiment, the drive unit can have a drive roller and a loop puller interacting with the drive roller. Depending on the draw force of the printing substrate web, the loop puller from the buffer reservoir can thereby rest on the drive roller and can establish the contact pressure force of the printing substrate web on the drive roller.

In a further preferred exemplary embodiment, channels for a negative pressure flow via which the printing substrate web are drawn to the edges of the side walls of the buffer reservoir are arranged in both side walls.

The pre-centering device can advantageously be mounted so as to be adjustable relative to the printing device. The pre-centering device can have a guide element that, for example, comprises two round extruded profiles over which the printing substrate web is directed in an S-shape. The pre-centering device can thereby be arranged such that it can rotate in order to establish the wrap angle, in particular around the extruded profiles.

In order to set the tension of the printing substrate web, the pre-centering device can provide a braking element (for example a braking brush) before the guide element or before the extruded profiles. Furthermore, the pre-centering device can have edge guides mounted to the side of the printing substrate web, which edge guides are adjustable to the width of the printing substrate web. A proper guidance of the printing substrate web through the pre-centering device is therefore ensured. If a suction device is arranged adjacent to the braking brush, the printing substrate web can additionally be cleaned.

An advantageous embodiment of the drive unit provides a drive roller driven by a step motor and a counter-pressure roller.

The buffer device can have a buffer reservoir under negative pressure that acts on the printing substrate web. If at least one sensor with which the loop of the printing substrate web in the buffer reservoir is scanned is arranged in the buffer reservoir, the sensor signal can be used to regulate the drive roller.

Via the use of a device made up of pre-centering device, drive unit and buffer device before the internal transport path of the printing device, the course of the printing substrate web in the printing device can be decoupled from external interference variables. The pre-centering device makes the guidance of the printing substrate web insensitive to the manner of how the printing substrate web is provided to the printing device. Furthermore, high process speeds are enabled via the exact control of the feed of the printing substrate web upon starting and stopping the printing substrate web. The printing substrate web is additionally supplied to the printing device with minimal transversal forces and a defined longitudinal force (web tension) via the use of a buffer device before the input of the internal transport path. A more stable travel of the printing substrate web and a good print image registration (for example upon printing a form) thereby result.

The buffer device to take up a slack of the printing substrate web can be arranged in the transport path of the printing substrate web to the printing device, from which buffer device the printing device then can draw the printing substrate web in the printing operation. The buffer device can have a buffer reservoir under negative pressure and—viewed in the transport direction of the printing substrate web—a drive unit arranged at the input of the buffer reservoir to convey the printing substrate web in the printing operation.

An advantageous buffer device has a buffer reservoir that provides at the floor a negative pressure device that generates negative pressure in the buffer reservoir that acts on the printing substrate web, and in which a drive unit is arranged adjacent to and above the one side wall of the buffer reservoir via which the printing substrate web is supplied to the buffer reservoir. The upper end of the other side wall of the buffer reservoir via which the printing substrate web is drawn from the buffer reservoir (for example by the printing device) can thereby be designed in sloped fashion.

In order to regulate the buffer device, sensors that scan the end of the loop of the printing substrate web in the buffer reservoir and generate a sensor signal dependent on the loop to control the drive unit can be arranged in the buffer reservoir.

The drive unit can advantageously be realized as a drive roller. The drive unit can thereby have a drive roller and a contact pressure roller resting on the drive roller in a freely movable manner.

It is advantageous when the drive unit provides a first drive roller arranged adjacent to and above the one side wall and a second drive roller arranged adjacent to the first drive roller in the buffer reservoir, between which first drive roller and second drive roller the printing substrate web is directed, and which first drive roller and second drive roller rotate in the direction towards the inside of the buffer reservoir. The second drive roller can then be rigidly arranged. Or the second drive roller can be realized so as to be adjustable in stages inside the buffer reservoir. Finally, the second drive roller can be variably or continuously adjustable In this embodiment the buffer device can be arranged adjacent to an input roller of the internal transport path of the printing device.

Adjacent to the upper end of the other side wall of the buffer reservoir, a third drive roller can be arranged that rotates in the direction of the buffer reservoir, or the other side wall of the buffer reservoir can have an air channel via which a negative pressure is exerted on the printing substrate web in the direction of the upper end of the side wall. The buffer device can then be arranged at a distance from the input roller of the internal transport path of the printing device.

In a further advantageous realization of the preferred embodiment, the drive unit can have a drive roller and a loop puller interacting with the drive roller. The contact pressure force of the printing substrate web on the drive roller is set depending on the draw force of the printing substrate web from the buffer reservoir.

Finally, channels for the negative pressure flow via which the printing substrate web is drawn onto the ends of the side walls of the buffer reservoir can be arranged in both side walls.

FIG. 1 shows the design described above of an electrographic printing device as it is disclosed in, for example, WO 98/39691 A1 or U.S. Pat. No. 6,246,856 B1. Via the preferred embodiment the feed module M1 is now changed such that the internal transport path TW in the printing device DR is decoupled from environmental influences that exist before the feed module M1. For the printing operation in the printing module M2 it is then unimportant whether the printing substrate web 10 is delivered from, for example, a stack, another printing device, or whether the stack is arranged on the floor or in the middle of the printing device DR, or whether the printing substrate web 10 is unrolled from a roll upon being fed.

Figure 2A:
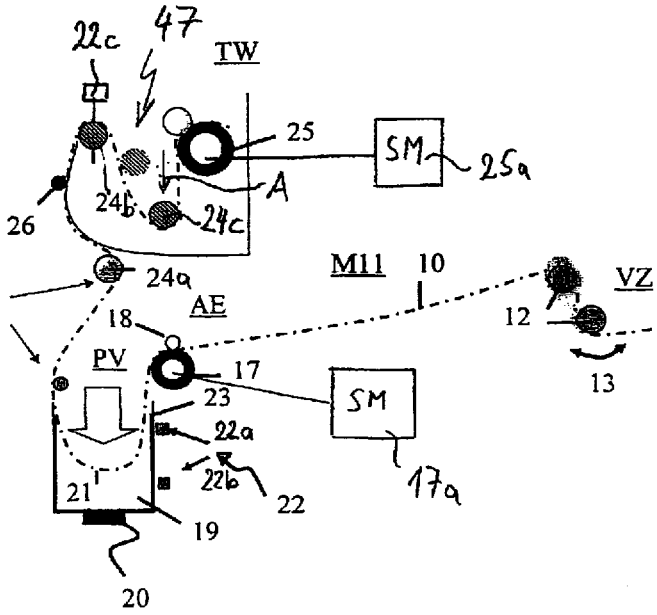
FIG. 2 is a feed device for a printing substrate web to a printing device, and a controller.

An embodiment of the device according to the preferred embodiment is shown in FIG. 2*a*. This is designated as feed device M1 in the following. The feed device M1 has a pre-centering device VZ, a drive unit AE, and a buffer device PV.

The printing substrate web 10 is fed from the buffer device PV to the internal transport path TW in the printing module M2.

The pre-centering device VZ has the task of feeding the printing substrate web 10, laterally aligned and pre-tensioned, to the drive unit AE. It can be arranged outside of the printing device DR or, depending on the feed type of the printing substrate web, in various ways at the printing device DR. For example, it can be realized with two round extruded profiles situated adjacent to one another over which the printing substrate web 10 is directed in an S-shape. A web tension is thereby already achieved in the pre-centering device VZ. The diameter of the extruded profiles 12 can be 60 mm, for example. In order to be able to adjust a web tension for the most different types of printing substrate web 10, the pre-centering device VZ is arranged such that it can rotate (indicated by the arrow 13) so that the wrap angle for the printing substrate web 10 is adjustable. A braking device (for example a braking brush of known design or, for example, a negative pressure brake) can additionally be arranged before the extruded profiles 12 (not shown in FIG. 2*a*). Via the pre-tensioning of the printing substrate web 10 that is achieved here, this is supplied to the drive unit AE in a stabilized fashion. A lateral drift of the printing substrate web 10 and folding of the printing substrate web 10 that is thereby caused are prevented. This result is further improved in that lateral edge guides of known design are mounted in the pre-centering device VZ (not shown in FIG. 2*a*) that can be adjusted depending on the width of the printing substrate web 10. If a brake brush should be arranged on the printing substrate web 10, this can be combined with a suction device of known design (not shown in FIG. 2) in order to clean the printing substrate web 10.

The drive unit AE arranged after the pre-centering device VZ can have the following technical features:

It can be arranged inside or outside the printing device DR.

It is suitable for all types of printing substrate web 10 and for all feed types of the printing substrate web 10 (feed of the printing substrate web 10 in the middle or on the floor of the printing device DR).

It possesses a drive roller 17 that interacts with a counter pressure roller (18) between which the printing substrate web 10 is directed; the drive roller 17 can be driven with a step motor 17*a*. High draw forces (approximately 60 N) can be achieved with this realization, wherein the transport of the printing substrate web 10 occurs nearly without slippage.

A regulation of the speed of the feed of the printing substrate web 10 is possible; it can occur in a known manner via the buffer device PV if at least one light barrier sensor that scans the end of the loop 21 of the printing substrate web 10 is arranged in the buffer device PV.

Sensor devices and drives can likewise be provided within the internal transport path TW of the printing device DR. In the shown exemplary embodiment, a sensor 22*c* is provided with which the transport speed of the printing substrate web 10 is measured via the unrolling speed of the roller 24*b*. The input roller 25 is driven via a step motor 25 that is controlled by a controller ST1 that also controls other drives, and therefore the feed of the printing substrate web in the pre-centering device VZ, the buffer device PV and the internal transport path TM up to the transport roller 25 are regulated altogether.

The regulation can, for example, be designed according to DE 10 2004 002 232 A (corresponding to US 2005/158099

Figure 3:
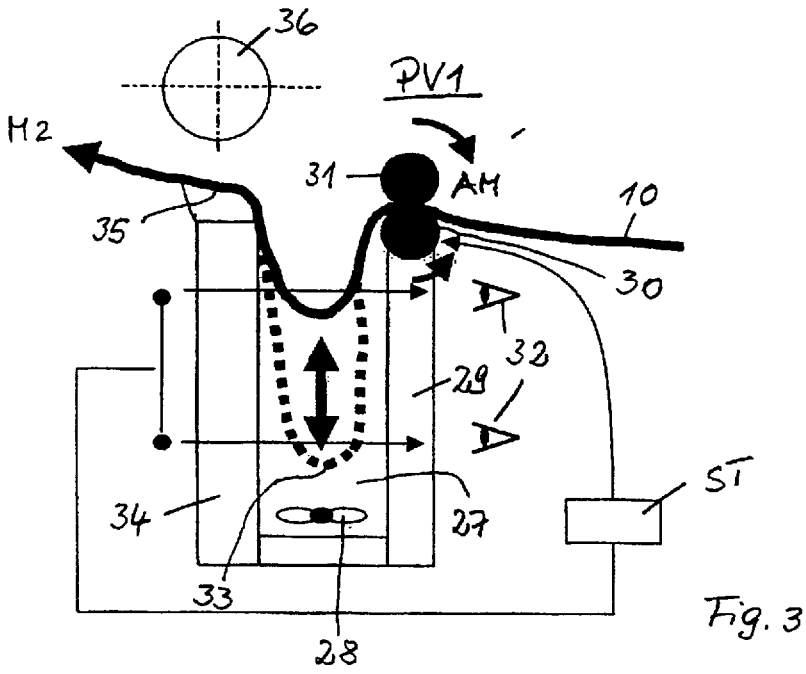
FIG. 3 is a first embodiment of a buffer device.
Figure 4:
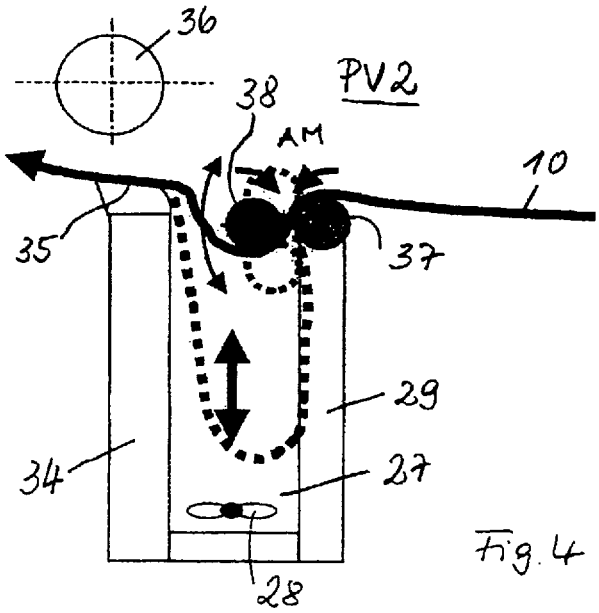
FIG. 4 is a second embodiment of a buffer device.

A1); see there in particular the statements regarding FIGS. 3 and 4. The entire content of these publications is herewith incorporated by reference into the present Specification.

The buffer device PV for the printing substrate web 10 has the following features according to FIG. 2:

- A buffer reservoir 19 is provided in which a negative pressure is generated by a negative pressure device 20, for example by a blower.
- A defined draw is exerted on the printing substrate web 10 in the buffer reservoir 19 by the negative pressure. Different types of printing substrate web 10 can therefore be directed by the buffer reservoir 19 without negatively affecting the function of the buffer device PV.
- The loop 21 of the printing substrate web 10 (in particular the vertical position of its curvature edge) can be measured with the help of sensors 22 (for example light barriers) or with a laser distance measurement device or an ultrasound distance measurement device. The sensor signals can then be used to control the feed of the printing substrate web 10 or the corresponding drive motors.
- The printing substrate web 10 can be cooled due to the air flow in the buffer reservoir 19. This is advantageous when the printing substrate web 10 comes from another printing device DR since then the printing substrate web 10 can be cooled and supplied to the printing module M2.
- The buffer device PV can be realized as an independent unit that, for example, can be arranged between two printing devices DR.
- The drive unit advantageously can be arranged on the one side wall 23 of the buffer reservoir 19 but can also be arranged adjacent to the buffer device PV.

The feed unit can follow the buffer device PV as part of the internal transport path TW of the printing module M2 that, for example, is designed corresponding to FIG. 2 and in which the printing substrate web 10 is supplied via multiple deflection rollers 24*a*, 24*b*, 24*c* to an input roller 25 via which the printing substrate web 10 is conveyed into the internal transport path TW. A guide roller 26 can additionally be provided that aligns the printing substrate web 10.

The sensor device 22 in FIG. 2*a* has a sensor 22*a* arranged below in the buffer device that emits a signal if the loop 21 reaches a predetermined maximum size. In this case it normally ensures that the motor 17*a* brakes and the feed of printing substrate becomes less or is stopped. At the output side, the extraction of the printing substrate web from the buffer device PV is essentially determined by the step motor 25*a*. This step motor 25*a* (whose transport is also determined by printing signals of the printing group and/or by signals of a superordinate controller of the entire printing device DR in addition to the sensors 22*a*, 22*b*, 22*c*), can also be operated in reverse in specific operating situations. In these cases, the printing substrate is initially buffered within the internal transport path TM in that the deflection roller 24*c* is moved in the direction A. The internal buffer storage 47 (which is of limited size and produced according to the loop puller principle shown in FIG. 1) is thereby sufficient to, for example, partially pull the printing substrate web 10 out of a printing group after a printing stop and continue the printing with accurate positioning on the printing substrate web 10 after the restarting of the printing process.

On the other hand, upon continuing the printing process the printing substrate web 10 is initially drawn from the internal buffer storage 47. If this internal storage approaches the end, the deflection roller 24*b* successively moves with relatively lesser acceleration due to the spring-mounted, pre-tensioned loop puller. This transport movement of the printing substrate web 10 is thus already detected relatively early by the sensor 22*c* and with flat slope, and the controller ST1 can start a correspondingly time-accurate, regulated run-up of the drive 17*a* at the buffer device PV without it leading to excessively high accelerations (and therefore tensions up to the point of tearing of the printing substrate web).

With the sensor 22*b* in the buffer device it is monitored that the loop 21 is not too small. If the sensor 22*b* outputs a corresponding signal, the drive 17*a* is accelerated or the drive 25*a* is delayed.

Figure 2B:
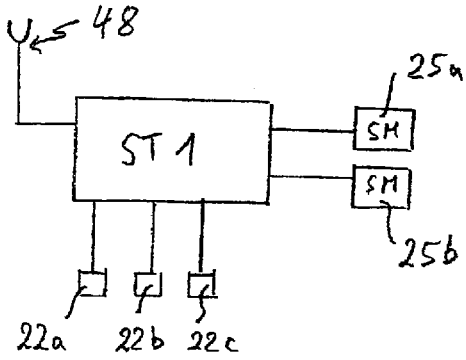

The controller ST1 is shown in FIG. 2*b*, as well as the sensors 22*a*, 22*b* and 22*c* connected to it, the step motors 25*a*, 25*b* and an input 48 for control signals that are delivered by one or more of the printing modules M1, M2, M3 or a superordinate system controller of the printing device DR. In the controller, workflows corresponding to the control characteristics described above are programmed in terms of software as computer program elements. For this the controller comprises a processor, a data bus, a system clock, input/output interfaces, memory units, and additional known elements of step motor controllers.

An important problem in the feed of printing substrate webs 10 to a printing module M2 is to prevent a slack of the printing substrate web 10. In order to avoid this problem, a buffer device PV independent of printing devices DR can be provided that is executed such that it can be inserted as needed between printing devices DR without having the change the printing devices DR. The buffer device PV can thus accept a slack condition of the printing substrate web 10 (that can occur during start-stop operation, for example) independent of the printing devices. In subsequent FIGS. 3 through 8, exemplary embodiments for buffer devices PV are shown that can be used both as part of a feed device M11 to a printing module M2 and in a stand-alone manner.

FIG. 3 shows a first embodiment PV1 of the buffer device PV according to the preferred embodiment. This has a buffer reservoir 27 in which a negative pressure is generated by a negative pressure device 28 (for example a blower) that acts on the printing substrate web 10 directed over the buffer reservoir 27 and draws this into the buffer reservoir 27 given a slack of the printing substrate web 10. A drive unit AM for the printing substrate web 10 (in FIG. 2 a drive roller 30 that interacts with at least one freely rotatable contact pressure roller 31) is provided at the input of the buffer reservoir 27 (as viewed in the transport direction of the printing substrate web 10) on the one side wall 29 of the buffer reservoir 27. With the drive roller 30 in cooperation with the contact pressure roller 31, printing substrate web 10 can be transported into the buffer reservoir 27. The buffer reservoir 27 is dimensioned so that it can accept the slack of the printing substrate web 10 given a retraction in the printing module M2. Sensors 32 (for example light barriers) that scan the length of the loop 33 of the printing substrate web 10 in the buffer reservoir 27 can be arranged in the buffer reservoir 27 to control the drive roller 20. The sensor signals can be supplied to a controller ST2 that controls the drive roller 30 such that sufficient printing substrate web 10 is contained in the buffer reservoir 27 or the quantity of the printing substrate web 10 contained in it or the transport of the printing substrate web 10 is regulated. The other side wall 34 of the buffer reservoir 27 is designed sloped at the upper end, via which slope 35 the printing substrate web 10 is supplied to the printing module M2. The buffer device PV1 can be arranged below an input roller 36 of the following printing module M2. The printing substrate web 10 can be moved into the internal transport path TW via the input roller 36.

The statements regarding the controller ST2 also apply for the exemplary embodiments of other Figures in which a control of drives (and thus a regulation of the transport of the printing substrate web) occurs by means of sensor signals.

In following FIGS. 4 through 8, elements that correspond to those of FIG. 3 are provided with reference characters that have been used in FIG. 3.

The buffer device PV2 according to FIG. 4 differs from that of FIG. 3 in that two drive rollers 37, 38 are provided as drive unit AM on the upper edge of the one side surface 29 of the buffer reservoir 27, which drive rollers 37, 38 rotate in opposite directions and in fact relative to one another, and of which the drive roller 38 can be pivoted continuously inside the buffer reservoir 27 and the drive roller 37 situated on the edge of the one side wall 29 of the buffer reservoir 27 is borne in a fixed manner. The printing substrate web 10 is directed between the two drive rollers 37, 38. The wrap angle of the printing substrate web 10 around the drive rollers 37, 38 can be changed in that the drive roller 38 situated in the buffer reservoir 27 is panned into the buffer reservoir 27. The remaining design of the buffer device PV2 can correspond to that of FIG. 3.

Figure 5:
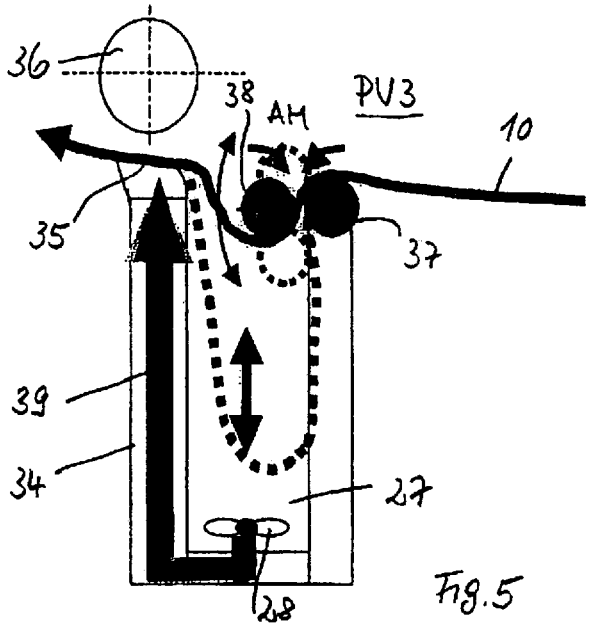
FIG. 5 is a third embodiment of a buffer device.

The buffer device PV3 of FIG. 5 is a development of the embodiment of the buffer device PV2 according to FIG. 4. In this embodiment, the other side wall 34 of the buffer reservoir 27 has a channel 39 for a negative pressure air flow via which the printing substrate web 10 is drawn onto the slope 35 of the side wall 34. The drive unit AM is designed corresponding to FIG. 4. The advantage of the embodiment of FIG. 5 is that the printing substrate web 10 is mechanically coupled with the second side wall 34 and the deflection of the second drive roller 38 itself can be designed so as to be self-adjusting.

Figure 6:
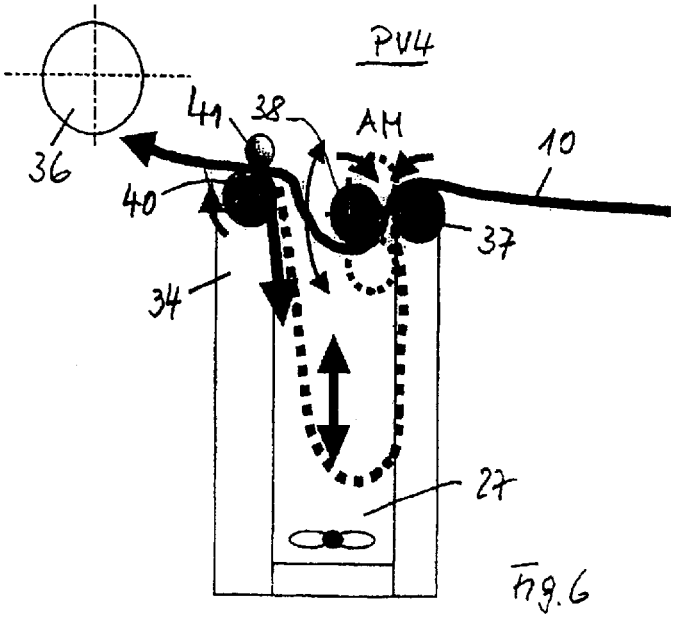
FIG. 6 is a fourth embodiment of a buffer device.

In the embodiment PV4 according to FIG. 6, in contrast to FIG. 4 a third driven roller 40 that interacts with a contact pressure roller 41 is arranged at the sloped end 35 of the second side wall 34. The rotation direction of this third drive roller 40 is such that it can transport printing substrate web 10 into the buffer reservoir 27. The third drive roller 40 can be controlled so that it transports the slack of the printing substrate web 10 into the buffer reservoir 27 upon occurrence of a retraction of the printing substrate web 10 so that the printing substrate web 10 automatically falls into the buffer reservoir 27 upon retraction. This solution has the advantage that the buffer device PV4 does not need to be arranged immediately adjacent to the input roller 36.

Figure 7:
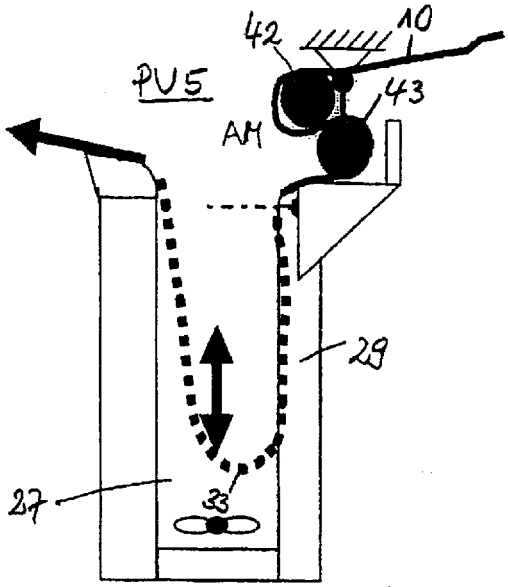
FIG. 7 is a fifth embodiment of a buffer device.

FIG. 7 shows an additional advantageous embodiment PV5 of the preferred embodiment. Here a drive roller 42 interacts with a loop puller 43 that is arranged offset from the drive roller 42 such that the printing substrate web 10 is directed around the edge of the one side surface 29. The position of the loop puller 43 is affected by the draw force on the printing substrate web 10 in the buffer reservoir 27. Given a slight pull on the printing substrate web 10, the loop puller 42 is already drawn onto the drive roller 42 and the printing substrate web 10 is pressed onto the drive roller 42. The consequence is that printing substrate web 10 is transported into the buffer reservoir 27. If the draw on the loop 33 of the printing substrate web 10 ceases, the effective connection of the loop puller 43 with the drive roller 42 is released and the transport of the printing substrate web 10 into the buffer reservoir 27 ends.

Figure 8:
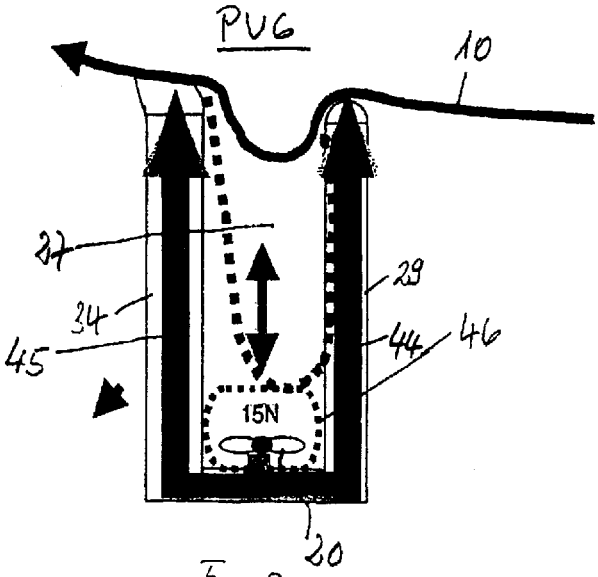
FIG. 8 is a sixth embodiment of a buffer device.

In the embodiment PV6 of FIG. 8, drive rollers as drive a unit have been foregone. Here air channels 44, 45 via which the printing substrate web 10 is drawn onto the edges of the side walls 29, 34 have been arranged in the side walls 29, 34. The printing substrate web 10 is drawn into the buffer reservoir 27 with a regulated negative pressure device 20 when a slack of the printing substrate web 10 occurs.

The negative pressure in the buffer reservoir 27 can be generated with the aid of a blower 20 that is arranged in the lower region of the buffer reservoir 27. A revolving perforated belt 46 can be arranged between blower 20 and the remainder of the buffer reservoir 27 in order to avoid friction and to prevent the printing substrate web 10 from being drawn into the blower 20. This is advantageous given solutions in which no regulation of the loop 21 of the printing substrate web 10 occurs.

An arrangement of a perforated unit (for example a perforated wall) above the blower 20 is likewise advantageous in the exemplary embodiments of FIG. 3 through 7.

The embodiments PV1 through PV6 shown in FIG. 3 through 8 can be varied in many ways without leaving the invention. In FIG. 4 through 6, a fixed spacing of the drive rollers 37, 38 can be selected; however, the spacing can also be selected so as to be adjustable in stages or variably. Via arrangement of an air cushion at the output of the buffer reservoir (output side wall 34), the friction of the printing substrate web at this point can be reduced. The printing substrate web 10 can be tightened with the aid of the drive roller 40 rotating in reverse, arranged at the output side wall 34.

The buffer devices PV1 through PV6 can be used in the feed device according to FIG. 2; the drive unit can then be used as a drive unit AE.

In addition to the aforementioned sensors, additional sensors can be arranged in the travel region of the printing substrate web to regulate the transport of the printing substrate web. The additional sensors can be arranged in the printing device and/or outside of the printing device. They can be provided before the printing device and/or after the printing device in the travel direction. One or more sensors can be provided in the region of the pre-centering device VZ; and one or more sensors can be arranged in the transport path TW in which a printing group lies. The printing group can operate on an electrical basis; however, it can also be based on other printing principles, for example the inkjet principle or also the offset printing principle. The sensors can respectively monitor the position, the draw tension, the speed and/or variables derived from these, for example the acceleration of the printing substrate web. The more sensors that are provided, the more complex that the regulation process can be; more precisely, the more precisely that the transport of the printing substrate web can be regulated. The statements regarding the sensors also apply for the drives: the more drives that are provided for the transport of the printing substrate web at the respective points within and outside of the printing device, the more precisely that the transport can be regulated (at least per region, but also as a whole).

Although preferred exemplary embodiments are shown and described in detail in the drawings and in the preceding specification, these should be viewed purely as examples and not as limiting the invention. It is noted that only preferred exemplary embodiments are presented and described, and all variations and modifications that presently and in the future lie within the protective scope of the invention should be protected.

We claim as our invention:

1. A device for supplying a printing substrate web to an internal transport path of the printing substrate web of a printing device, comprising:

a pre-centering device that accepts the printing substrate web from a printing substrate web source, the pre-centering device has a guide and tensioning element via which the printing substrate web is directed in an S-shape with a wrap angle and wherein the pre-centering device is designed so as to be able to rotate to adjust the wrap angle;

a drive unit comprising first and second adjacent drive rollers with the web in between, the first drive roller being a driven drive roller, said drive unit following an output of the pre-centering device and which draws the printing substrate web from the pre-centering device and thereby drives the pre-centering device, said drive unit receiving the web under tension provided by the pre-centering device;

a buffer device at the drive unit and which has a buffer reservoir, said driven first drive roller being on and fixed at an edge of a side wall of the buffer device facing said pre-centering device, the second drive roller being adjacent to the first drive roller in the buffer reservoir such that it can pivot, the buffer reservoir having at a floor a negative pressure device that generates a negative pressure in the buffer reservoir, the negative pressure of the negative pressure device acting on the printing substrate web to pull the printing substrate web drawn by the drive unit into the buffer reservoir and thereby tensions the printing substrate web before it is supplied to the internal transport path.

2. The device according to claim 1 in which the pre-centering device is mounted so as to be adjustable on the printing device.

3. The device according to claim 1 in which the pre-centering device comprises as a guide and tensioning element two extruded profiles around which the printing substrate web is directed in an S-shape.

4. The device according to claim 1 in which another side wall of the buffer reservoir where the web exits has an air channel open at a top that is connected with the negative pressure device.

5. The device according to claim 1 in which a third drive roller is arranged adjacent to an edge of another side wall where the web exits.

6. The device according to claim 1 in which at least one sensor that scans an end of a loop of the printing substrate web in the buffer reservoir is arranged in the buffer reservoir and generates a sensor signal depending on the loop to control the drive unit.

7. The device according to claim 6 in which the drive unit has a step motor controlled by the sensor signal that drives the first driven drive roller.

8. The device according to claim 1 in which a perforated unit is arranged above the negative pressure device.

9. The device according to claim 1 in which the printing substrate web is supplied from the buffer reservoir to the internal transport path via multiple deflection rollers, a guide roller, and an input roller.

10. The device according to claim 1 in which extraction of the printing substrate web from the buffer device is determined by a step motor, an activation of the step motor with a controller being determined by first and second sensors arranged in the buffer device and that measure a loop size of the printing substrate web, and a third sensor that measures a rolling speed of a deflection roller.

11. The device according to claim 10 wherein the activation of the step motor is additionally determined by at least one of printing signals of the printing device and signals of a superordinate controller of the printing device.

12. The device according to claim 1 in which the second drive roller comprises a driven roller, and a third driven drive roller is provided that rotates in a direction of the buffer reservoir and is arranged adjacent to an edge of a side wall opposite the side wall at which said drive unit is arranged.

13. A buffer device to accept a printing substrate web in an electrographic printing device, comprising:

said buffer device being an independent unit that is arranged arbitrarily outside of the printing device, and that has a buffer reservoir under negative pressure and a drive unit arranged at an input of the buffer reservoir, viewed in a transport direction of the printing substrate web, with which the printing substrate web can be conveyed into the buffer reservoir;

the buffer reservoir has at a floor a negative pressure device that generates a negative pressure acting on the printing substrate web in the buffer reservoir;

the drive unit having first and second adjacent drive rollers with said web in between, the first drive roller being driven and fixed at an edge of and on a side wall of the buffer reservoir via which the printing substrate web is supplied to the buffer reservoir, and the second drive roller being in the buffer reservoir such that it can pivot;

at least one sensor that scans an end of a loop of the printing substrate web in the buffer reservoir and which is arranged in the buffer reservoir and generates a sensor signal dependent on the loop to control the driven first drive roller; and a controller to which the sensor signal is supplied and that controls the driven first drive roller.

14. The device according to claim 13 in which another opposite side wall of the buffer reservoir that is opposite the buffer reservoir side wall has an air channel via which a negative pressure is exerted on the printing substrate web at an edge of the opposite side wall.

15. The device according to claim 13 in which a perforated unit is arranged above the negative pressure device.

16. A device for supplying a printing substrate web to an internal transport path of the printing substrate web of a printing device, comprising:

a tensioning device that accepts the printing substrate web from a printing substrate web source, the tensioning device having a tensioning element;

a drive unit comprising first and second adjacent drive rollers with said web in between, at least said first drive roller being a driven drive roller, and said drive unit receiving the web under tension provided by the tensioning device;

a buffer device at the drive unit and which has a buffer reservoir, said driven first drive roller being on and fixed at an edge of a side wall of the buffer device facing said tensioning device, the second drive roller being arranged in the buffer reservoir such that it can pivot, the buffer reservoir having a negative pressure device that generates a negative pressure in the buffer reservoir, the negative pressure of the negative pressure device acting on the printing substrate web to pull the printing substrate web driven by the drive unit into the buffer reservoir and thereby tensions the printing substrate web before it is supplied to the internal transport path.

17. The device of claim 16 wherein a side wall of the buffer device opposite said side wall at which the drive unit is arranged has an upwardly sloping surface with a rounded surface at a beginning of the sloping surface, both surfaces being shaped and positioned such that said substrate web slides over both surfaces as the web leaves the buffering device.

* * * * *